US005675318A

United States Patent [19]

Hunt, Jr.

[11] Patent Number: 5,675,318

[45] Date of Patent: Oct. 7, 1997

[54] GRAFFITI PREVENTION APPARATUS

[76] Inventor: Henry C. Hunt, Jr., 875 Rio Virgin Dr., #205., St. George, Utah 84770

[21] Appl. No.: 642,873

[22] Filed: May 6, 1996

[51] Int. Cl.[6] ..... G08B 21/00

[52] U.S. Cl. ..... 340/540; 340/541; 222/61; 222/153.11; 222/402.1

[58] Field of Search ..... 340/540, 541, 340/573; 222/61, 63, 153.11, 402.1, 402.11; 52/101; 109/20, 33

[56] References Cited

U.S. PATENT DOCUMENTS

| | | | |
|---|---|---|---|
| 3,815,784 | 6/1974 | Hansel | 222/63 |
| 4,866,423 | 9/1989 | Anderson | 340/541 |
| 4,996,521 | 2/1991 | Hollow | 340/691 |
| 5,025,962 | 6/1991 | Renfro | 222/649 |
| 5,528,220 | 6/1996 | Woods | 340/541 |

*Primary Examiner*—Jeffery Hofsass
*Assistant Examiner*—Anh La
*Attorney, Agent, or Firm*—Terrell P. Lewis

[57] ABSTRACT

A system of components for preventing the application of graffiti to property includes one or more sensors and a signal transmitter at or near the surface to be defaced, and signal receiving means for actuating a mechanism in the spray apparatus or at the surface to be protected which will enable prevention of the surface targeted for defacement. One embodiment of the invention includes a signal receiver in the spray canister which actuates an electromagnet to move a plug in the marking material delivery tube to a flow blocking position. A second embodiment of the invention includes a signal receiver in the spray canister coupled to a rotatable magnet for rotating the upper end of the delivery tube away from the spray nozzle thereby breaking the path through which the marking material travels from the spray apparatus to the target surface. A third embodiment of the invention provides for the creation of an electromagnetic field at the targeted surface, and the mixing of the marking material (either by the "paint" manufacturer or afterwards) with a magnetic material so that when sprayed at the surface, the marking material is repelled.

12 Claims, 2 Drawing Sheets

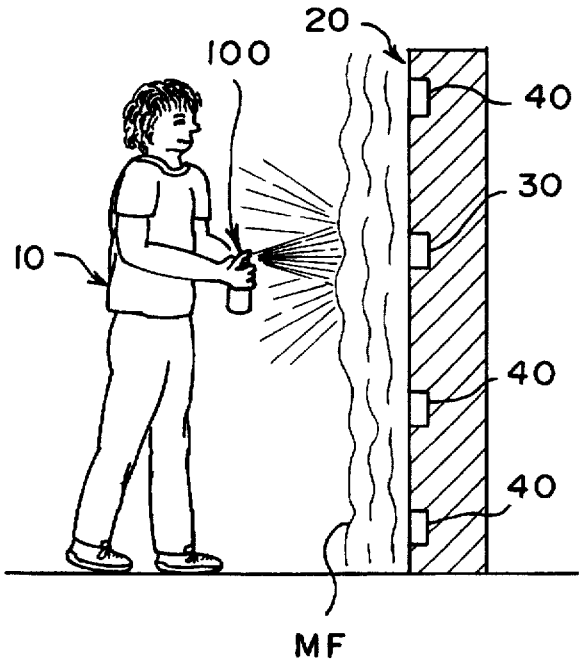
FIG. 1
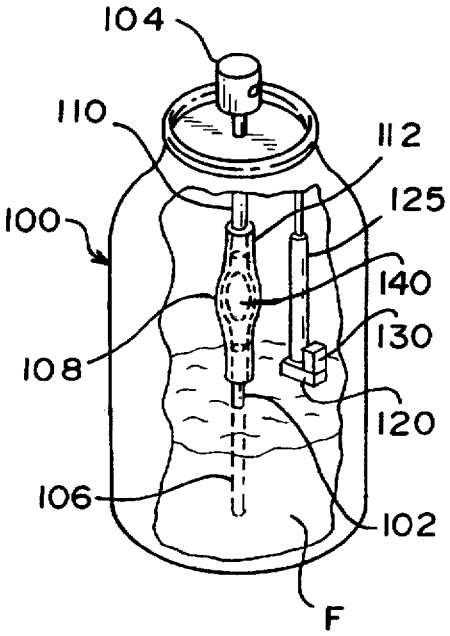
FIG. 2
FIG. 5
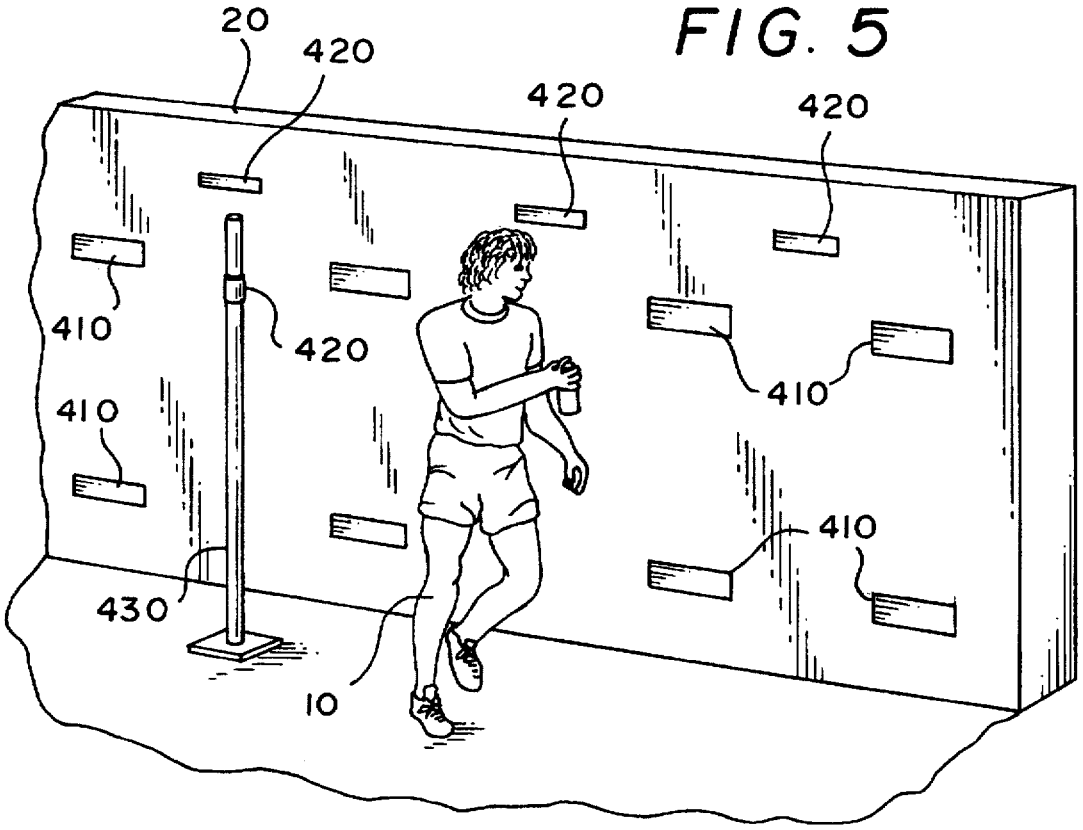

GRAFFITI PREVENTION APPARATUS

BACKGROUND OF THE INVENTION

1. Field of the Invention

The present invention relates to apparatus for defeating the application of graffiti and other undesirable markings to structures and surfaces, and more particularly to a system of components which cooperate to prevent the application of unwanted or unsightly markings and symbols on surfaces or structures by individuals bearing spray cans of marking media.

2. Description of the Related Art

One recent problem that contemporary western society has encountered is the deliberate defacement of otherwise aesthetically pure and unblemished surfaces by decadent or otherwise indecent individuals. Whether its application is intentional or a result of boredom, the marks or "graffiti", as it has become known, is generally an assault on the visual pleasures of man.

Almost always, graffiti is accomplished by an act of writing or drawing while using paint. Spray paint cans are the tools of choice. Drawing or writing on a structure or surface typically detracts from its appearance. Graffiti, when viewed as a problem, must be firmly dealt with.

At the present time, the only known way to correct graffiti is to provide a remedy after its application, as for example, by its erasure or the application of one or more coats of media (e.g., paint) to cover the graffiti. Either procedure is very costly.

Various mechanisms are known for deterring theft or intrusion; however, each of these, described below, are unable to prevent the damage from occurring in the first place.

U.S. Pat. No. 4,996,521 to Hollow discloses apparatus for spraying water on an intruder to deter unauthorized graffiti within an area. However, the surface still bears the graffiti after the water been sprayed.

U.S. Pat. No. 5,182,541 to Bajorek et al. discloses a theft deterring device for houses or automobiles where the device, connected electrically to pre-existing circuitry, will cause the emission of noxious gas upon the unauthorized entry of an intruder. Again, the deterrent is not activated until the damage (the entry) has been accomplished.

Other mischief preventing mechanisms known include a car theft prevention system (U.S. Pat. No. 5,315,290 to Moreno et al.) and a dye pack for prevention of theft of currency (U.S. Pat. No. 5,196,828 to Keniston).

It would therefore be very desirable to find a process and apparatus which would help deter application of graffiti to a surface.

It would further be desirable to have a deterring mechanism, such as valve defeating means, in the graffiti applying tool, or in the surface to which the graffiti is to be applied.

U.S. Pat. No. 5,025,962 to Renfro discloses a valve assembly for a pressurized aerosol can to release a measured amount of spray automatically at preset time intervals. This apparatus, which uses the pressurized contents as the sole energy source to drive the valve assembly, has an objective of spray delivery, whereas to prevent graffiti it would be desirable to prevent spraying.

OBJECTS OF THE PRESENT INVENTION

It is therefore the principal object of the present invention to provide a method and apparatus for preventing the application of graffiti to an object or a surface, while overcoming all the disadvantages and drawbacks of known methods and apparatus for graffiti application.

Another object of the present invention is to provide a method and apparatus for preventing the defacement of structural surfaced by sprayed paint through actuation of a valve disabling means carried by the spray mechanism or by the surface of the structure.

Still another object of the invention is to provide a method and apparatus for deterring intrusions into a defined space to deface property by actuation, upon recognition of an intruder in the space, of valve means in a spray can carried by the intruder, for preventing delivery of the marking material from the can to the property.

Still another object of the invention is to provide a method and apparatus for deterring the defacing of property by actuating signal transmitting means on or in the vicinity of the property for communication with means for preventing operation of a spraying apparatus.

These and other objects are attained by the present invention which encompasses a system of components including at least (1) one or more sensors at or in the vicinity of a surface to be defaced for detecting the presence of an intruder approaching the targeted surface, and (2) first communication means for actuating a mechanism in the spray apparatus or in the surface to be protected which will enable prevention of the surface targeted for defacement.

In one embodiment, the invention also includes a second communication means in the spray apparatus to be used in defacing the surface, coupled with a control means for disabling the delivery of marking material from the spray canister to the targeted surface when an intruder bearing such a spray apparatus approaches the surface.

In another embodiment, the invention also includes a second communication means in the spray apparatus coupled to a servo mechanism for breaking the path through which the marking material travels from the spray apparatus to the targeted surface when an intruder with such a spray apparatus approaches the surface.

In still another embodiment of the invention, the mechanism for preventing marking of the targeted surface is carried by the surface itself or devices positioned in the vicinity of the surface. That is, the marking material is combined with a magnetic material prior to or at the time of loading the spray canister. When a proximity sensor on, or in the vicinity of, the structure is triggered by an approaching intruder, a magnetic field created along the targeted surface acts to repel the spray of marking media directed at it.

BRIEF DESCRIPTION OF THE DRAWINGS

These and other objects and advantages of the present invention will become more apparent when considered together with the following detailed description of the invention along the appended drawings, in which:

FIG. 1 is a schematic view showing an intruder approaching a surface with the intent to deface it, and components of which the inventive system is comprised;

FIG. 2 is a perspective view of a spray can and valving mechanism in accordance with one embodiment of the invention;

FIG. 5 is a representation of the field generating apparatus in accordance with another embodiment of the present invention.

DETAILED DESCRIPTION OF THE INVENTION

Figure 3:
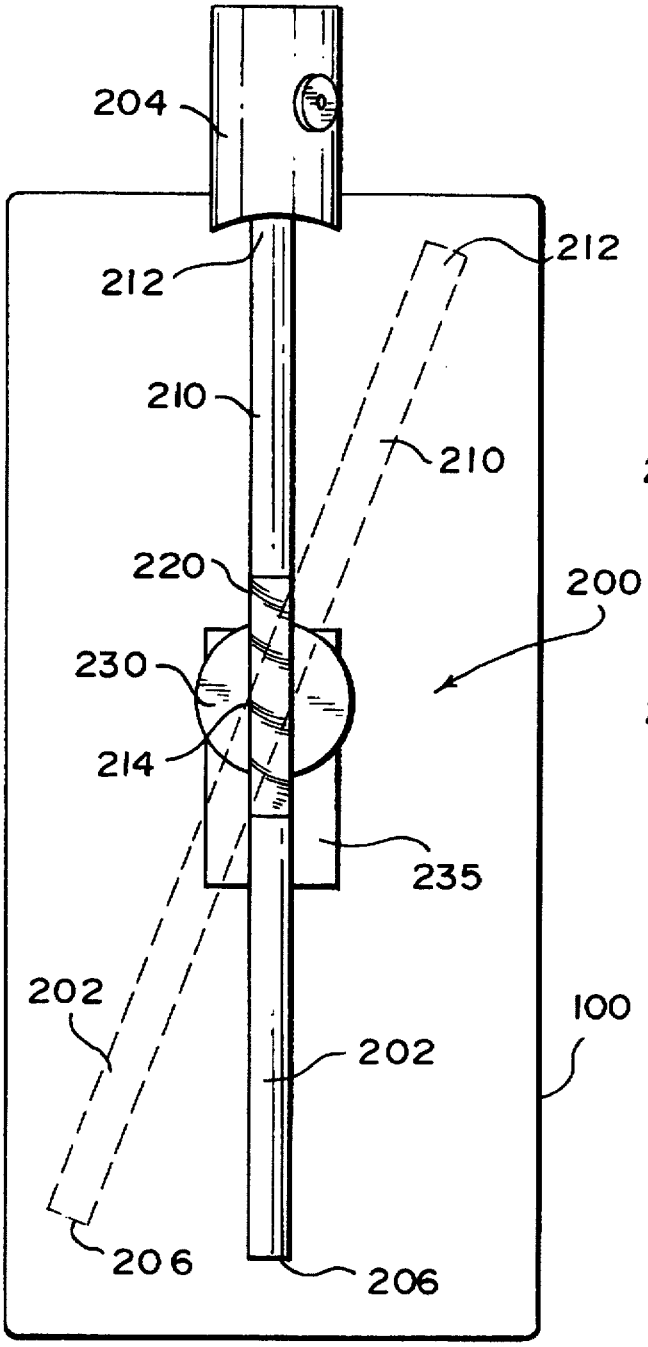
FIG. 3 is a partial sectional view of the interior of a spray apparatus, in accordance with a second embodiment of the present invention.

The following detailed description is of the best currently contemplated modes of carrying out the invention. The description is not to be taken in a limiting sense, but is made merely for the purpose of illustrating the general principles of the invention, since the actual scope of the invention can be best determined by the appended claims.

Referring now to FIG. 1, there is shown an intruder 10 coming into proximity with a wall or other structure 20. The intruder is holding a spraying apparatus, such as a paint spray can 100, in his hand ready to begin spraying the wall with the paint to deface the wall. As the intruder enters the detection range of a detector 30, a transmitter 40, which is electrically coupled to the detector, is actuated so that an electromagnetic signal is emitted. The signal is received by a disarming mechanism in can 100.

In FIG. 2, one embodiment of the spray can disarming mechanism contemplated by the invention is shown. The spray can 100 has a dispensing tube 102 with a lower end portion 106 having a lower end disposed in a fluid reservoir F and an upper end portion 110 with an upper end attached to the spray nozzle 104.

The dispensing tube 102 is disposed along the longitudinal axis of the spray can, and includes a central section 108 which is of greater diameter than the upper and lower end portions of the dispensing tube.

Preferably, the upper end portion of the central section receives the lower end of portion 110 and the upper end portion of the central section receives the upper end of portion 106 in a snug, fluid tight, fit. The central section 108 of the tube is elongated in the longitudinal direction of the spray can and houses a plug 140 made of magnetic material which is capable of longitudinal travel between a lower position where the lower end of the plug rests adjacent the upper end of portion 106, and an upper position where the upper end of the plug rests adjacent the lower end of portion 110. Positioned adjacent the central section of the tube are a receiver 120, a power supply 130, and an electromagnet 125 (the functioning of which will be described below). These three latter components can be carried by one side surface of the spray can (eg., on a shelf), suspended from an upper portion of the can, or supported by the floor of the can.

Under normal conditions of use, the plug 140 resides in the lower region of the central tube section 108, and the pressurized gas inside the can has enough force to lift the plug from the upper end of portion 106 to allow the paint to flow through the central tube section.

When a person 10 approaches the wall 20 and enters the area monitored by the motion detector 30, the transmitter 40 is activated. In turn, the receiver 120 in the spray can 100 is activated. The receiver is functionally coupled to the power source 130 to initiate its operation. The power source enables operation of the electromagnet 125, setting up an electromagnetic field which acts upon the plug 140. Under the influence of the field, the plug moves from its lower position in the tube central section to the upper position described above, where the flow of fluid from within the reservoir F through the lower tube portion 106 is blocked from entering the upper tube end 110.

The receiver 120, the power source 130 and the electromagnet 125 can be provided as a subassembly mounted on an inside surface of the spray can or suspended from the lid of the spray can.

Alternatively, the receiver, power source and electromagnet can be combined as a single component (e.g., mounted on a PC board or provided on a circuit chip) and secured to the outer surface of the tube central portion 108.

Figure 4:
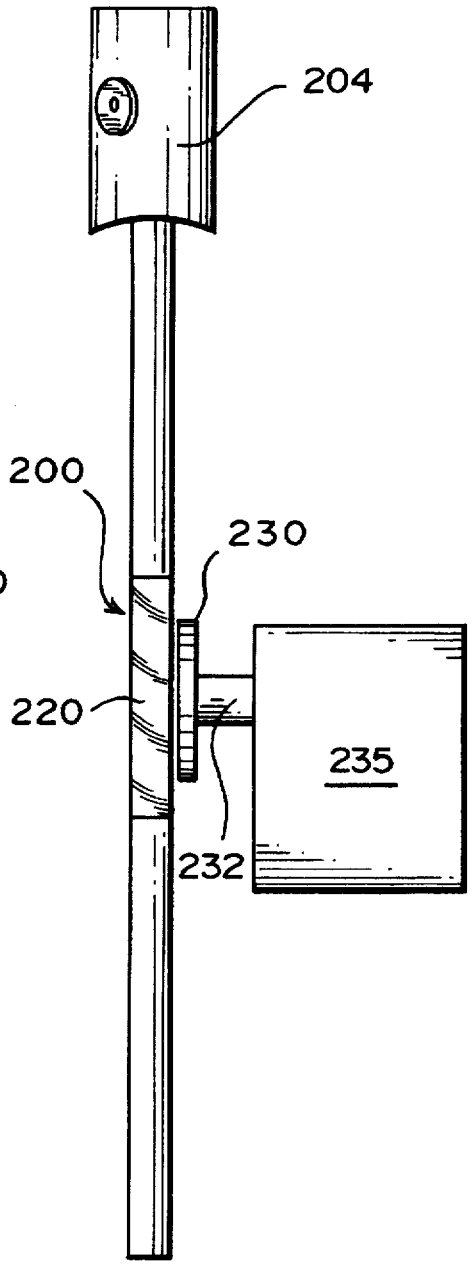
FIG. 4 is a side view of the interior of the spray-defeating mechanism shown in FIG. 3.

FIGS. 3 and 4 show a second embodiment of a spray disabling mechanism (identified generally with the numeral 200) which is to be carried within the spray can 100. In this embodiment, the dispensing tube includes an upper portion 210 having one end 212, and a lower portion 202 having an end 206. The tube itself is preferably of constant diameter throughout its length. A metal strip 220 having magnetic properties is secured at about the central section 214 of the tube. Positioned immediately adjacent to the strip and to one side of the dispensing tube is a magnetic disk or plate 230 which is carried by a housing 235. The housing can be mounted on an inside surface of the can 100 or suspended from the top of the can, and contains a receiver, a power source and an motor (not shown).

The motor is actuated when the receiver detects a signal emitted by the transmitter 40. The motor causes the disk to rotate about an axis extending along the shaft 232 connecting the disk to the housing. This axis is also normal to the longitudinal axis of the dispensing tube.

The upper end of the dispensing tube is secured to the dispensing cap 204 of the spray can at a central location of the undersurface where a fluid transfer channel of the type found in conventional spray caps can be formed (such a channel is not shown here). It is contemplated that the upper end of the dispensing tube and the underside of the cap 204 will be configured to permit the upper end of the dispensing tube to be rotated out of alignment with the fluid transfer channel.

FIG. 5 shows another embodiment of the present invention which contemplates surface mounted apparatus for thwarting the application of graffiti by an intruder 10 bearing a paint spray can and malevolent intentions.

In this embodiment, the fluid contents of the spray can is modified to include a ferrous material, such as a powder or ink, which can be combined with the paint. The mixing of the ferrous material and paint can be accomplished by the paint manufacturer or by the spray paint can manufacturer.

FIG. 5 shows a wall 20 which has been targeted by an intruder 10 to receive graffiti. Mounted on the wall is a plurality of magnetic field generating components 410, positioned preferably at spaced longitudinal and vertical locations. The components 410 are activated by signals transmitted by motion or presence sensors 420. The components 410 will preferably be disposed in groups located in proximity to the sensors 420, but the invention also contemplates all of the components 410 being activated by signals transmitted (or emitted) from any one or more of the sensors 420. Preferably, the components 410 are mounted on the wall 20, on one or more posts 430 located in proximity to the wall, or on both the wall and the posts (as shown in FIG. 5). The signals emitted by the sensors actuate the magnet field generating components 410 to create an electromagnetic field parallel to the wall surface, when the sensors detect the presence of the intruder 10.

When the intruder directs the spray from the can at the wall surface to be marked, the pressurized ferrous material-containing marking fluid emerging from the can is repelled by the electromagnetic field created by components 410.

This embodiment of the inventive system will not only result in the prevention of the marking fluid from reaching the wall surface, but also (and most likely) in the repulsion of the fluid back from the electromagnetic field onto the intruder, thus "marking" him for later identification.

While the present invention has been described in conjunction with specific embodiments thereof, it is evident that many alternatives, modifications, and variations will be apparent to those skilled in the art in light of the foregoing description. Accordingly, the present invention is intended to embrace all alternatives, modifications, and variations which fall within the spirit and scope of the appended claims.

What I claim is:

1. A graffiti thwarting system, comprising:

proximity detectors adapted to be mounted adjacent a surface to be defaced, transmitter means, supported adjacent said surface, for emitting signals, and means, responsive to said transmitter means signals, for preventing marking material released from a pressurized spray canister from reaching said surface.

2. The graffiti thwarting system of claim 1, wherein said transmitter means comprises radio transmitting means, and said preventing means includes radio receiving means.

3. The graffiti thwarting system of claim 1, wherein said preventing means comprises a delivery tube for transporting said marking media to a spray nozzle, and means coupled with said delivery tube for inhibiting the flow of said marking material to said spray nozzle.

4. The graffiti thwarting system of claim 3, wherein said flow inhibiting means comprises an enlarged conduit section connecting upper and lower delivery tube portions, and plug means supported for movement in said conduit section between a first flow permitting position and a second flow inhibiting position.

5. The graffiti thwarting system of claim 4, wherein said enlarged conduit is elongated in the direction of the extent of the delivery tube, and said plug moves linearly between said first and second positions.

6. The graffiti thwarting system of claim 4, wherein said spray canister further includes means, actuated by the signals emitted by said transmitter means, for driving said plug between said first end second positions.

7. The graffiti thwarting system of claim 6, wherein said means for driving said plug between said first and second positions comprises an electromagnet.

8. The graffiti thwarting system of claim 7, wherein said driving means further includes a power source and means coupled with said power source for selectively actuating said electromagnet.

9. The graffiti thwarting system of claim 3, wherein said spray preventing means includes means for breaking the connection between said delivery tube and said spray nozzle.

10. The graffiti thwarting system of claim 9, wherein said delivery tube includes a magnetic portion, and said connection breaking means comprises a rotatable magnetic disk positioned adjacent said magnetic portion of said delivery tube, motor means coupled with and actuatable to rotate said disk, and means carried by said spray canister for selectively actuating said motor means, whereby when said motor means is actuated, an upper portion of said delivery tube is rotated out of correspondence with said spray nozzle channel.

11. The graffiti thwarting system of claim 10, wherein said magnetic portion of said delivery tube includes a magnetic strip secured to the exterior surface of said tube.

12. The graffiti thwarting system of claim 1, wherein said preventing means comprises signal receiving means, field generating means coupled with said signal receiving means for creating a magnetic field adjacent to said surface, and ferromagnetic material mixed with said spraying material, whereby when the marking material is released from said pressurized spray canister, said marking material is repelled by said magnetic field created adjacent to said surface.

* * * * *